US009016028B2

(12) United States Patent
Bedard

(10) Patent No.: US 9,016,028 B2
(45) Date of Patent: Apr. 28, 2015

(54) GARAGE DOOR TRACK BRACKET SHIM

(71) Applicant: Robert Bedard, Holden, MA (US)

(72) Inventor: Robert Bedard, Holden, MA (US)

( * ) Notice: Subject to any disclaimer, the term of this patent is extended or adjusted under 35 U.S.C. 154(b) by 0 days.

(21) Appl. No.: 13/887,016

(22) Filed: May 3, 2013

(65) Prior Publication Data

US 2013/0312363 A1 Nov. 28, 2013

Related U.S. Application Data

(60) Provisional application No. 61/644,923, filed on May 9, 2012.

(51) Int. Cl.

| | |
|---|---|
| ***E04B 1/00*** | (2006.01) |
| ***E05D 15/16*** | (2006.01) |
| ***E05D 15/24*** | (2006.01) |

(52) U.S. Cl.

CPC ..... *E05D 15/165* (2013.01); *Y10T 16/379* (2015.01); *E05D 15/24* (2013.01); *E05Y 2600/634* (2013.01)

(58) Field of Classification Search

USPC ..... 52/126.1, 745.15, 745.16; 384/626; 411/537

See application file for complete search history.

(56) References Cited

U.S. PATENT DOCUMENTS

| | | | | |
|---|---|---|---|---|
| 4,232,068 | A * | 11/1980 | Hoh et al. | 428/43 |
| 6,254,140 | B1 * | 7/2001 | Erwin | 285/3 |
| 6,560,934 | B1 * | 5/2003 | Workman | 52/126.1 |
| 8,205,406 | B2 * | 6/2012 | Hiscock et al. | 52/506.06 |

* cited by examiner

*Primary Examiner* — Jeanette E Chapman
*Assistant Examiner* — Daniel Kenny
(74) *Attorney, Agent, or Firm* — Dunlap, Bennett & Ludwig; Kevin Pepper; Lynn McBee

(57) ABSTRACT

A shim for providing extra space between a garage door track and a garage door wall. The shim may be mounted in between the garage door wall and a track bracket that supports the garage door track. The shim may be inserted prior to mounting the garage door track or after mounting the garage door track. The shim may include a screw guide slot so that a screw may secure the bracket and the shim to the garage wall.

6 Claims, 3 Drawing Sheets

GARAGE DOOR TRACK BRACKET SHIM

BACKGROUND OF THE INVENTION

The present invention relates to a shim and, more particularly, to a shim for providing additional space for a garage track.

Currently, when installing garage doors, the exterior perimeter of the door may make contact with the building and may thereby interfere with the operation of the door. In some instances, metal washers or wood blocks may be used. However, the metal washers have to be stacked very carefully on the fastener coming through the back of the track bracket before the door makes contact with the building, making them hard to install. Further, metal washers can be quite expensive and may eventually rust. Alternatively, wood blocks may have to be nailed to the building first and then painted. However, the wood may end up splitting during installation or rotting in the near future.

As can be seen, there is a need for a shim that may be used to easily create space between the garage track and the garage wall.

SUMMARY OF THE INVENTION

In one aspect of the present invention, a device for providing additional space comprises; a first shim having a first side, a second side, a top side, a bottom side, a front surface and a rear surface, wherein a slot extending through the front surface and the rear surface is formed in between the first side, the second side, the top side, and the bottom side, and wherein the slot is formed to extend through the second side; and a lip protruding from the front surface and the first side of the shim.

In another aspect of the present invention, a method of providing additional clearance space comprises: providing a shim having a first side, a second side, a top side, a bottom side, a front surface and a rear surface, wherein a slot extending through the front surface and the rear surface is formed in between the first side, the second side, the top side, and the bottom side, and wherein the slot is formed to extend through the second side, and comprising a lip protruding from the front surface and the first side of the shim; fastening the front surface of the shim to a track bracket using an adhesive, with the slot of the shim being aligned with a screw opening in the track bracket; and drilling a screw through the track bracket, through the slot of the shim and into a wall of a garage.

In another aspect of the present invention, a method of providing additional clearance space comprises: providing a shim having a first side, a second side, a top side, a bottom side, a front surface and a rear surface, wherein a slot extending through the front surface and the rear surface is formed in between the first side, the second side, the top side, and the bottom side, and wherein the slot is formed to extend through the second side, and comprising a lip protruding from the front surface and the first side of the shim; loosening a screw that secures a bracket to a wall, wherein the bracket is attached to a garage door track; fitting the shim in between the bracket and the wall, wherein the screw fits within the slot of the shim, the front surface of the shim is facing towards the bracket, and wherein the lip is pressed against an edge of the bracket; and securing the screw back into the wall, whereby the shim is secured in between the wall and the bracket and the bracket is secured to the wall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a shim for providing extra space between a garage door track and a garage door wall. The shim may be mounted in between the garage door wall and a track bracket that supports the garage door track. The shim may be inserted prior to mounting the garage door track or after mounting the garage door track. The shim may include a screw guide slot so that a screw may secure the bracket and the shim to the garage wall.

The present invention may include a garage door track bracket shim. The shim of the present invention may attach to the exterior of the track mounting bracket, which may thereby move the tracking away from obstruction. The shims of the present invention add the thickness needed, in an easy one step application. The present invention may give maximum surface contact for fastening. Further, the present invention is not effected by moisture, will not rust or split, and provides a neat and professional look.

Figure 1:
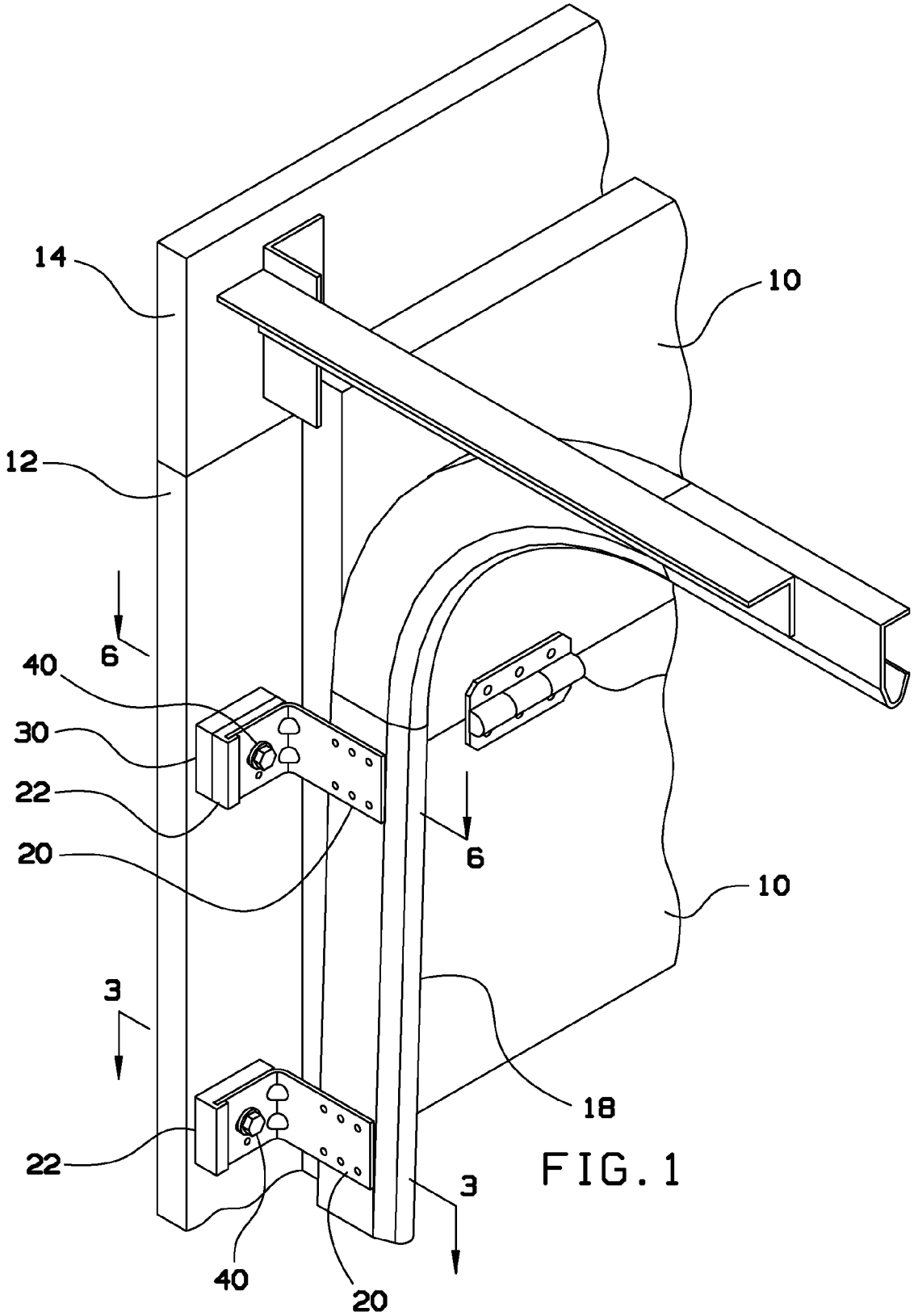
FIG. 1 is a perspective view of the present invention shown in use.
Figure 2:
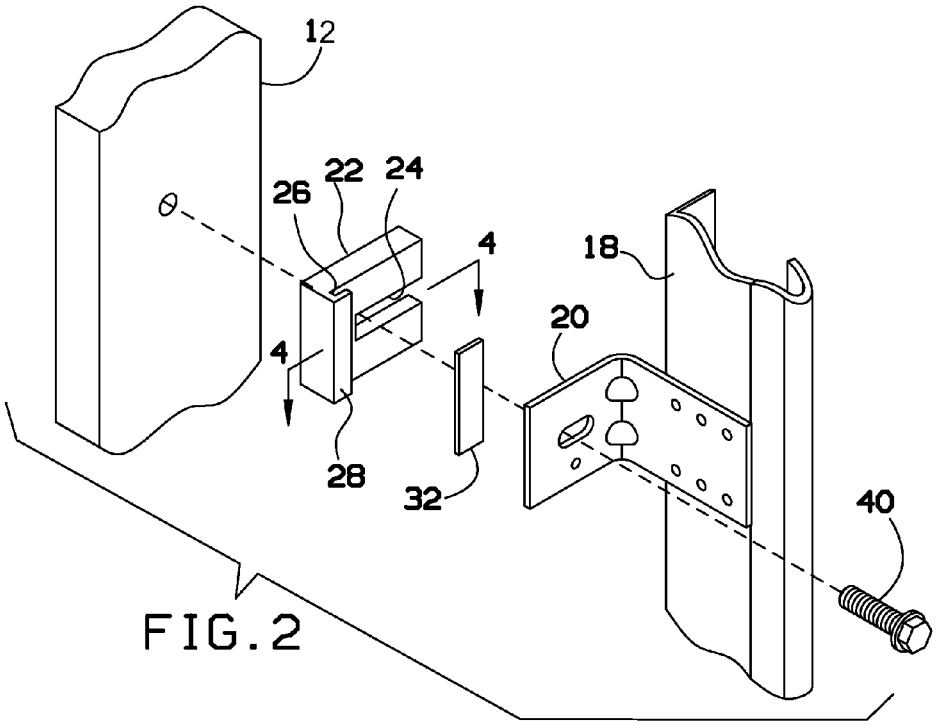
FIG. 2 is an exploded perspective view of the present invention.
Figure 3:
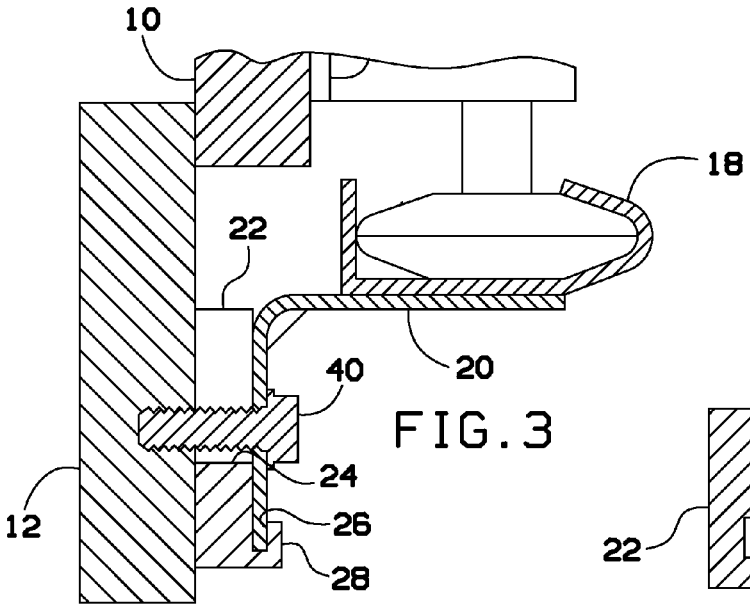
FIG. 3 is a detailed section view of the present invention taken along line 3-3 in FIG. 1.
Figure 4:
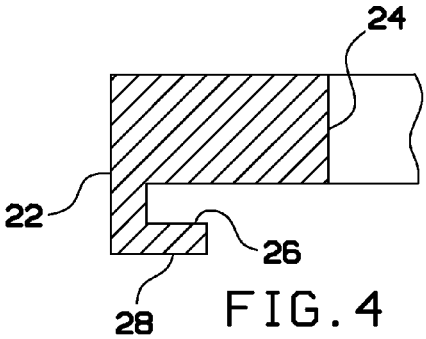
FIG. 4 is a detailed section view of the present invention taken along line 4-4 in FIG. 2.
Figure 5:
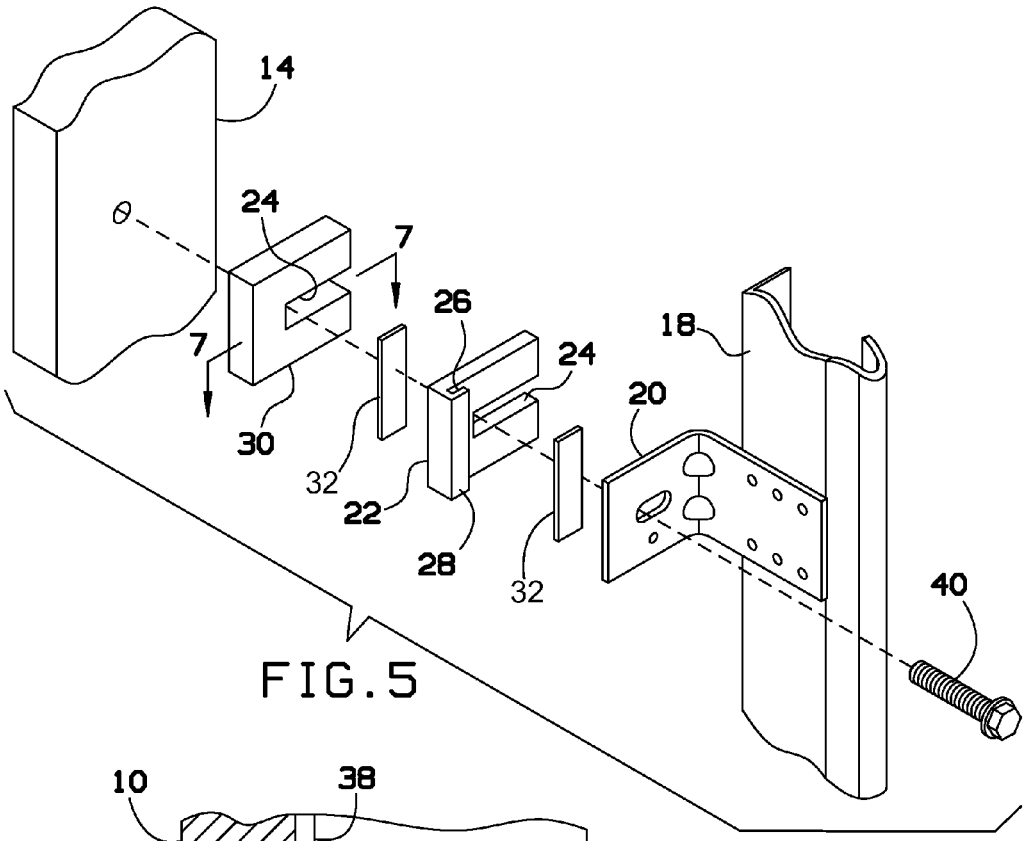
FIG. 5 is an exploded perspective view of an alternate embodiment of the present invention.
Figure 6:
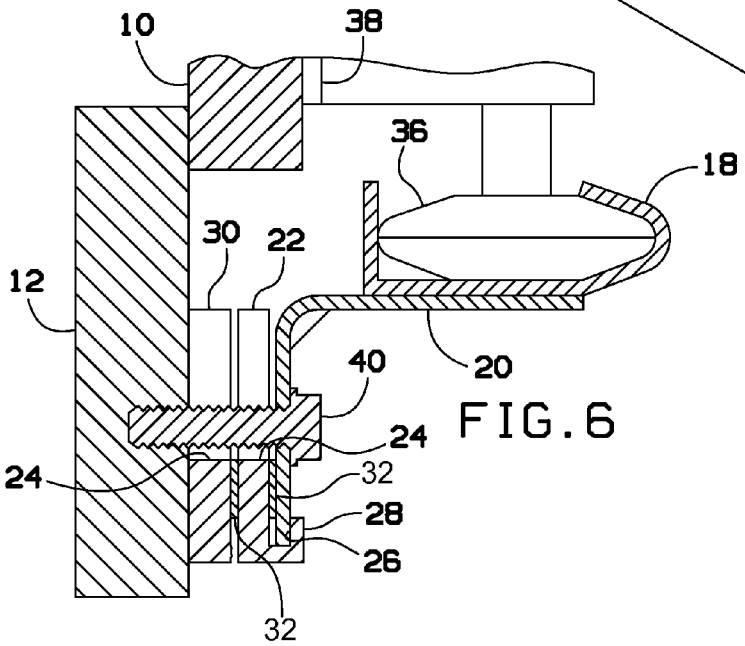
FIG. 6 is a detailed section view of the alternate embodiment of the present invention taken along line 6-6 in FIG. 1 with additional alternative components.

Referring to FIGS. 1 through 7, the present invention may include a shim 22. The shim 22 may be used to provide additional space between a track 18 and the side frame board 12 and a top frame board 14 of a garage. The track 18 is generally mounted to the side frame board 12 by a track bracket 20. The shim 22 may provide the additional space by being mounted in between the track bracket 20 and the side frame board 12, and thereby spacing the track 18 further away from the side frame board 12. The additional space added by the shim 22 may prevent the garage door 10 from hitting either the side frame board 12 or the top frame board 14 of the garage while the garage door 10 is either being opened or closed.

The shim 22 of the present invention may include a first side, a second side, a top side, and a bottom side. The shim 22 may further include a front face and a rear face. The front face and the rear face may be substantially flat. In certain embodiments, the shim 22 may include a screw guide slot 24 formed in between the first side, second side, top side and bottom side, and extending through the front surface and the rear surface. In certain embodiments, the top side and the bottom side may be separated by the screw guide slot 24 extending through the second side. As illustrated in the Figures, the screw guide slot 24 may extend to the second side, and thereby separate the top side and the bottom side at the second side.

In certain embodiments, the shim 22 of the present invention may further include a lip 28 extending from the front face of the shim 22. In certain embodiments, the lip 28 may extend from the front face on the first side of the shim 22 and may extend from the bottom side to the top side of the shim 22. In certain embodiments, the lip 28 may include a portion extending towards the second side, and thereby the lip may form an alignment slot 26 within. An edge of the track bracket 20 may fit within the alignment slot 26 and thereby align the track bracket 20 with the shim 22.

In certain embodiments, the present invention may further include an adhesive strip 32, such as double sided tape. The adhesive strip 32 may be placed on at least one of the front face and the rear face of the shim 22. In certain embodiments, the adhesive strip 32 may secure the track bracket 20 to the shim 22 prior to the installation of the track 18. This may allows a user to easily install the bracket 20 and the shim 22 as one unit.

To add additional space between the track 18 and the side frame board 12, additional shims 30 may be used. The additional shims 30 may not include the lip 28 and may be layered in between the shim 22 and the side frame board 12. In certain embodiments, an adhesive strip 32 may attach a second shim 30 and a first shim 22 to create a single unit. Multiple additional shims 20 may be added depending on how much space between the track 18 and the side frame board 12 is desired.

A method of spacing the track 18 from the side frame board 12 may include the following. If a problem exists before installation, which may include needing more clearance, a measurement of the correction needed may be taken. Match the measurement to the available thickness of the shim 22. A user may remove any protective layer from the adhesive strip 32 on the shim 22, exposing the adhesive strip 32. The user may then align the edge of the bracket 20 with the alignment slot 26 within the lip 28 of the shim 22. The user may then press the bracket 20 against the front surface of the shim 22 and thereby press the adhesive strip against the bracket 20. This may join the shim 22 with the bracket 20. In alternate embodiments, a user may then attach a second shim 30 without a lip 28 to the rear surface of the shim 22 with another adhesive strip 32. The shim 22 and bracket 20 may then be properly aligned with the side frame board 12 and mounted to the side frame board 22 using a screw 40. The screw 40 may go through the bracket 20, through the screw guide slot 24 of the shim 22 and into the side frame board 12, thereby mounting the bracket 20 and shim 22 to the side frame board 12.

If the track system is in place, a user may loosen the screws and pull back the existing track 18 to a proper clearance. The user may then align the screw guide slot 24 on the open end, such as the second side, with the screw. The user may push the screw guide slot 24 of the shim 22 over the screw until the edge of the bracket 20 is within the alignment slot 26 of the lip 28. Once in place, the screw may be retightened. The original screw 40 may also be removed without the shim 22 moving and be replaced with a longer screw 40 if needed.

It should be understood, of course, that the foregoing relates to exemplary embodiments of the invention and that modifications may be made without departing from the spirit and scope of the invention as set forth in the following claims.

What is claimed is:

1. A device for providing additional space comprising;

a first shim having a first side, a second side opposite the first side and substantially parallel with the first side, a top side, a bottom side opposite the top side, a front surface and a rear surface opposite the front surface, wherein a slot extending through the front surface and the rear surface is formed in between the first side, the second side, the top side, and the bottom side, and wherein the slot is formed to extend through the second side towards the first side; and a lip protruding from the front surface and the first side of the shim, and comprising a portion extending towards the second side forming an alignment slot between the portion and the front surface.

2. The device of claim 1, further comprising an adhesive strip attached to the front surface of the shim.

3. The device of claim 1, wherein the front surface and the rear surface are substantially flat.

4. The device of claim 1, wherein the lip extends an entire length from the top side to the bottom side of the shim.

5. The device of claim 1, further comprising a second shim having a first side, a second side, a top side, a bottom side, a front surface and a rear surface, wherein a slot extending through the front surface and the rear surface is formed in between the first side, the second side, the top side, and the bottom side, and wherein the slot is formed to extend through the second side, wherein the second shim comprising an adhesive strip on the front surface, wherein the adhesive strip connects the front surface of the of the second shim to the rear surface of the first shim, wherein the slot of the second shim is aligned with the slot of the first shim.

6. A device for providing additional space comprising;

a first shim having a first side, a second side, a top side, a bottom side, a front surface and a rear surface, wherein a slot extending through the front surface and the rear surface is formed in between the first side, the second side, the top side, and the bottom side, and wherein the slot is formed to extend through the second side, wherein the first shim comprises a lip protruding from the front surface and the first side; and a second shim having a first side, a second side, a top side, a bottom side, a front surface and a rear surface, wherein a slot extending through the front surface and the rear surface is formed in between the first side, the second side, the top side, and the bottom side, and wherein the slot is formed to extend through the second side, wherein the second shim comprising an adhesive strip on the front surface, wherein the adhesive strip connects the front surface of the of the second shim to the rear surface of the first shim, wherein the slot of the second shim is aligned with the slot of the first shim.

* * * * *